United States Patent [19]

Isobe

[11] Patent Number: 5,061,967

[45] Date of Patent: Oct. 29, 1991

[54] ELECTROPHOTOGRAPHIC RECORDING APPARATUS

[75] Inventor: Minoru Isobe, Tokyo, Japan

[73] Assignee: Oki Electric Industry Co. Ltd., Tokyo, Japan

[21] Appl. No.: 417,513

[22] Filed: Oct. 5, 1989

[30] Foreign Application Priority Data

Oct. 5, 1988 [JP] Japan ..... 63-249782

[51] Int. Cl.[5] ..... G03G 21/00

[52] U.S. Cl. ..... 355/310; 83/153; 83/278; 83/423; 271/9; 355/271; 355/311

[58] Field of Search ..... 226/101, 102, 74, 110; 355/308, 309, 310, 311, 316, 317, 271, 274; 83/153, 211, 278, 423; 225/96.5; 400/593, 605, 607, 608.3, 621

[56] References Cited

U.S. PATENT DOCUMENTS

| | | | |
|---|---|---|---|
| 4,017,169 | 4/1977 | Komura et al. | 355/274 |
| 4,377,333 | 3/1983 | Tsuji et al. | 355/309 |
| 4,707,704 | 11/1987 | Allen et al. | 355/213 X |
| 4,890,140 | 12/1989 | Negoro et al. | 226/74 X |
| 4,925,325 | 5/1990 | Niikawa | 400/605 X |
| 4,941,377 | 7/1990 | Ishihara et al. | 83/211 |

FOREIGN PATENT DOCUMENTS

| | | |
|---|---|---|
| 227116 | 7/1987 | European Pat. Off. . |
| 60-22143 | 2/1985 | Japan . |

OTHER PUBLICATIONS

Patent Abstracts of Japan, vol. 6, No. 248 (P-160)(1126) Dec. 7th, 1982 & JP-A-57 146267 (Fuji Xerox K.K.) Sep. 9th, 1982.

Patent Abstracts of Japan, vol. 12, No. 296 (M-731)(3143) Aug. 12th, 1988, & JP-A-63 74853 (Fujitsu K.K.) Apr. 5th, 1988.

Patent Abstracts of Japan, vol. 6, No. 62 (P-111)(940) Apr. 21st, 1982, & JP-A-57 4066 (Nippon Denki K.K.) Jan. 9th, 1982.

*Primary Examiner*—Arthur T. Grimley
*Assistant Examiner*—Christopher Horgan
*Attorney, Agent, or Firm*—Spencer & Frank

[57] ABSTRACT

An electrophotographic recording apparatus records an image on a recording paper, either a cut recording sheet or a continuous recording paper, through steps of feeding the recording paper along a paper feed plane exclusively for the recording paper, stopping the recording paper upon the arrival of the same at a predetermined, exclusive starting position, forming an electrostatic latent image on a photoconductor by an exposure unit as the photoconductor is rotated at a fixed surface speed, developing the electrostatic latent image in a toner image by a developing unit by applying a toner charged in a polarity opposite that of the electrostatic latent image, restarting the feed of the recording paper at a feed seed corresponding to the surface speed of the photoconductor upon the arrival of the first line of the toner image formed on the surface of the photoconductor at a position which will coincide with a fixed recording position on the recording paper at a transfer position, transferring the toner image from the photoconductor to the recording paper, and fixing the transferred toner image to the recording paper by a fixing unit. When the toner image is thus formed on the continuous recording paper, a portion of the continuous recording paper carrying the toner image is cut off by a cutting unit, and then the continuous recording paper is retracted to the starting position.

7 Claims, 6 Drawing Sheets

ELECTROPHOTOGRAPHIC RECORDING APPARATUS

BACKGROUND OF THE INVENTION

1. Field of the Invention

The present invention relates to an electrophotographic recording apparatus and, more particularly, to a paper feed mechanism for an electrophotographic recording apparatus.

2. Description of the Prior Art

Electrophotographic recording apparatus are used widely as output units of computers, word processors and facsimile equipment. Various types of electrophotographic recording apparatus differing from each other depending on the type of recording medium have been developed. An electrographic recording apparatus disclosed, for example, in J.P.Provisional Pub. (Kokai) No. 60-22143 comprises first and second transfer units capable of being selectively set at a position opposite a toner image formed on the surface of a photoconductor, a first recording paper feed mechanism for feeding a cut sheet of a fixed length into a gap between the photoconductor and the first transfer unit, a first fixing unit for fixing a toner image transferred to the cut recording sheet, a second recording paper feed unit for feeding a continuous recording paper into a gap between the photoconductor and the second transfer unit, and a second fixing unit for fixing a toner image transferred to the continuous recording paper. The recording paper feed mode of the electrophotographic recording apparatus is changed by operating switches provided on a control unit to record images on cut recording sheets or on a continuous recording paper.

Incidentally, the second paper feed mechanism of this known electrographic recording apparatus has two pairs of sprockets disposed on a paper feed path respectively on the opposite sides of a transfer position to feed the continuous recording paper. If the continuous recording paper is reversed, the leading edge of the continuous recording paper is disengaged from the sprockets. Therefore, the continuous recording paper must be set on the sprockets every time the continuous recording paper is reversed, and hence it is undesirable to reverse the continuous recording paper. If the continuous recording paper is not reversed to remove the same from the transfer position, the cut recording sheet is fed over the continuous recording paper in transferring a toner image to the cut recording sheet, which reduces the effective Coulomb force available for transferring the image to thereby reduce toner image transferring effect. Accordingly, separate paper feed paths must be prepared respectively for cut recording sheets and a continuous recording paper, and separate movable transfer units and fixing units must be provided respectively for cut recording sheets and continuous recording paper, which makes the paper feed mechanism complex and increases the size of the electrophotographic recording apparatus. Furthermore, in recording new information, a large blank is formed inevitably after the preceding recording area in which information has previously been recorded to waste the continuous recording paper, because the continuous recording paper cannot be reversed, and the operator must take the trouble to cut the continuous recording paper into cut recording sheets each carrying a group of data.

SUMMARY OF THE INVENTION

It is a principal object of the present invention to provide an electrophotographic recording apparatus of a simple mechanism and a compact construction, comprising a single transfer unit and a single fixing unit, which are used in common for recording information on a cut recording sheet and for recording information on a continuous recording paper and having separate paper feed paths respectively for feeding the cut recording sheet to the transfer unit and for feeding the continuous recording paper to the same transfer unit, and a single paper feed path along which both the cut recording sheet and the continuous recording paper are fed to the fixing unit.

It is another object of the present invention to provide an electrophotographic recording apparatus capable of reversing a continuous recording paper to save the continuous recording paper.

It is a third object of the present invention to provide an electrophotographic recording apparatus capable of cutting a printed portion of a continuous recording paper every time a desired printing operation is completed so that the operator is released from the trouble to cut the continuous recording paper.

To achieve the objects of the invention, the present invention provides an electrophotographic recording apparatus comprising a second paper feed mechanism for feeding a continuous recording paper, comprising a tractor mechanism passing outside the opposite ends of a photoconductor, passing in a paper feed plane different from that of a first paper feed mechanism before a transfer position, and passing in a paper feed plane common to both the first and second paper feed mechanisms between the transfer position and a position near a fixing unit, a cutting mechanism for cutting the printed continuous recording paper along a line perpendicular to the paper feed direction, and driving means for reversing the tractor mechanism to put back the leading edge of the continuous recording paper to a starting position on a paper feed plane different from that of the first paper feed mechanism after cutting the printed portion of the continuous recording paper.

The above and other objects, features and advantages of the present invention will become more apparent from the following description taken in conjunction with the accompanying drawings.

DESCRIPTION OF THE PREFERRED EMBODIMENTS

Figure 1:
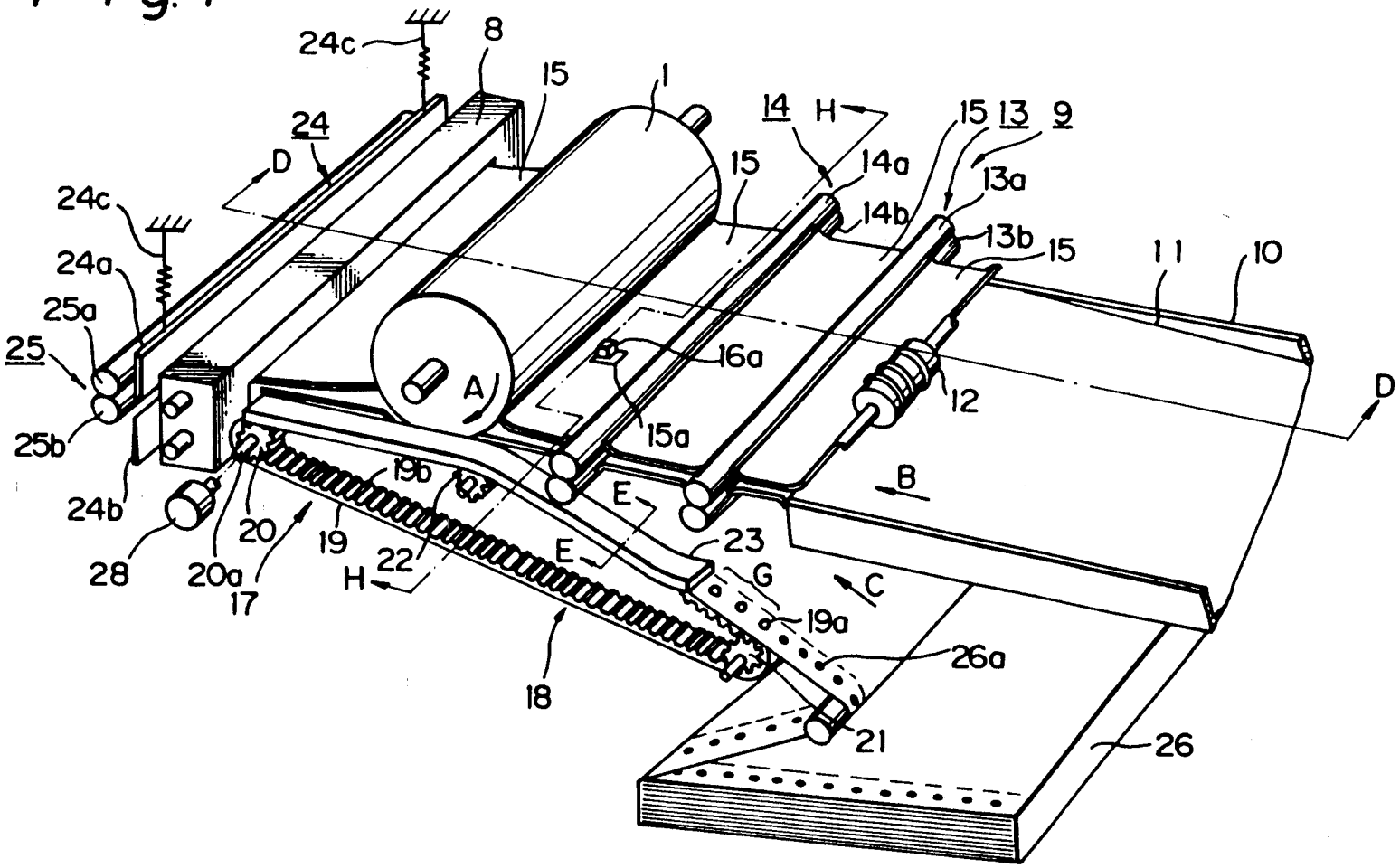
FIG. 1 is a schematic perspective view of an electrophotographic recording apparatus in a preferred embodiment according to the present invention.

An electrophotographic recording apparatus in a first embodiment according to the present invention will be described with reference to the accompanying drawings, in which the same or like parts are denoted by the same reference characters throughout.

Figure 2:
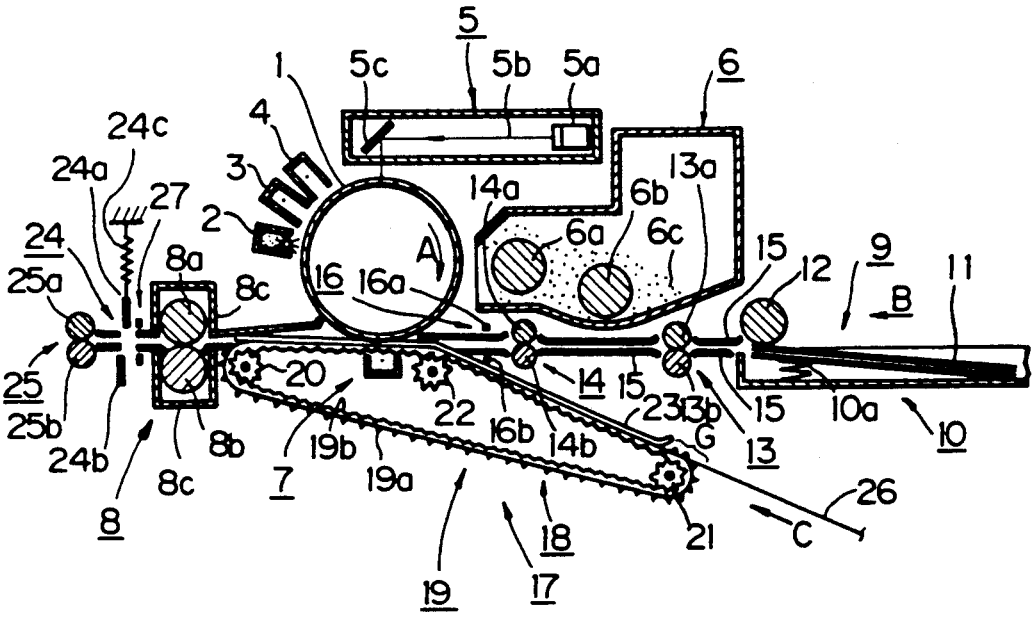
FIG. 2 is a reduced sectional view taken on line D—D in FIG. 1.

In FIG. 1 showing the electrophotographic recording apparatus in a first embodiment according to the present invention, an exposure unit 5, a developing unit 6 and the associated parts, which are arranged around a photosensitive member (photoconductive drum) 1, are omitted for simplicity, and the exposure unit 5, the developing unit 6 and the associated parts are shown in FIG. 2.

Referring to FIGS. 1 and 2, a cleaning unit 2, a static eliminator 3, a charging unit 4, the exposure unit 5, the developing unit 6 and a transfer unit 7 are arranged around the photoconductive drum 1 respectively at design positions on a frame, not shown. The photoconductive drum 1 is supported rotatably on the frame and is driven by a driving unit, which will be described afterward, for rotation. The exposure unit 5 is provided with a laser light source 5*a* which emits a laser beam 5*b* according to information signals, and a reflecting mirror 5*c* for reflecting the laser beam 5*b* emitted by the laser light source 5*a*. The developing unit 6 is provided with a stirring member 6*b* for stirring toner 6*c* contained in a toner tank, and a developing roller 6*a* for transporting the toner 6*c* to a developing region. The transfer unit 7 charges the backside of a recording paper at a transfer position near the circumference of the photoconductive drum 1 with an electric charge of a polarity opposite that of the electric charge of a toner image formed on the circumference of the photoconductive drum 1 to transfer the toner image from the photoconductive drum 1 to the recording paper by a Coulomb force. The cleaning unit 2 removes the toner 6*c* remaining over the circumference of the photoconductive drum 1 after the transfer of the toner image from the photoconductive drum 1 to the recording paper. The static eliminator 3 applies an electric charge of a polarity opposite that of an electrostatic latent image formed on the circumference of the photoconductive drum 1 to eliminate the electric charge of the photoconductive drum 1.

Figure 3:
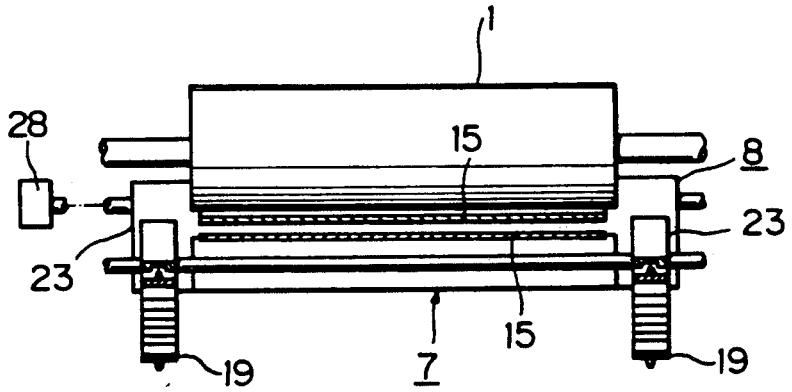
FIG. 3 is a reduced sectional view taken on line H—H in FIG. 1.
Figure 4:
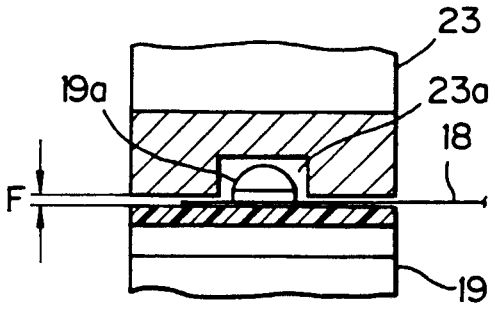
FIG. 4 is an enlarged sectional view taken on line E—E in FIG. 1.

A first paper feed mechanism 9 comprises a cassette 10 for containing cut recording sheets 11 in a neat stack, a feed roller 12, a sheet separating unit 13, a register unit 14, a sheet guide 15, a sheet detector 16 for detecting the placement of the leading edge of a cut recording sheet 11 at a set starting position. The cassette 10 can removably be put on the frame. The sheet separating unit 13 has a pair of rollers 13*a* and 13*b* pressed against each other. The register unit 14 has a pair of rollers 14*a* and 14*b* pressed against each other. The stack of the cut recording sheets 11 is biased upward by a spring 10*a* so that the uppermost cut recording sheet 11 is pressed against the feed roller 12. The feed roller 12, the rollers 13*a* and 13*b* of the sheet separating unit 13, and the roller 14*a* and 14*b* of the register unit 14 are journaled on the frame for rotation, and are driven synchronously at the same surface speed through a transmission mechanism by the driving unit to feed the cut sheets through the region up-stream of the transfer position and a region between the transfer position and a position near the fixing unit 8. The sheet guide 15 comprises a pair of guide plates placed one over the other so as to guide the cut recording sheet 11 in the paper feed direction. The sheet detector 16 comprises a luminous element 16*a* disposed above the sheet guide 15 and light receiving element 16*b* disposed under the sheet guide 15 opposite to the luminous element 16*a*, and is disposed at a position between the register unit 14 and the photoconductive drum 1. Openings 15*a* are formed in the guide plates of the sheet guide 15 to allow the light emitted by the luminous element 16*a* to travel to the light receiving element 16*b*. A second paper feed mechanism 17 comprises a pin tractor mechanism 18 and guide members 23. The pin tractor mechanism 18 can be driven in the normal direction or in the reverse direction by a stepping motor 28. The pin tractor mechanism 18 comprises a pair of toothed driving pulleys 20, a pair of toothed driven pulleys 21, a pair of toothed tension pulleys 22, and a pair of pin-traction belts 19, which are disposed symmetrically respectively outside the opposite ends of the photoconductive drum 1 as shown in FIG. 3. The output shaft of the stepping motor 28 is connected to one end of a shaft 20*a* fixedly mounted with the toothed driving pulleys 20. Pins 19*a* are fixed to and project outwardly from the upper surfaces of the pin-traction belts 19 and are longitudinally arrange therealong at a pitch corresponding to that of perforations 26*a* of a continuous recording paper 26 so that the pins 19*a* are able to engage the perforations 26*a*. Teeth 19*b* capable of meshing with the teeth of the toothed driving pulleys 20, the toothed driven pulleys 21 and the toothed tension pulleys 22 are formed on the bottom side of the pin-traction belts 19. Each guide member 23 is attached to the frame so as to extend over the entire range of engagement of the pins 19*a* of the pin-traction belt 19 and the perforations 26*a* of the continuous recording paper 26, except a continuous paper lead-in region G (FIG. 1). As shown in FIG. 4, a groove 23*a* is formed longitudinally in the lower surface of each guide member 23 to receive the extremities of the pins 19*a* of the pin-traction belt 19. A gap F slightly greater than the thickness of the continuous recording paper 26 is formed between the lower surface of the guide member 23 and the upper surfaces of the pin-traction belts 19. The toothed tension pulleys 22 are disposed between the sheet detector 16 and the transfer unit 7 so that the upper surface of the pin-traction belt 19 coincides with a paper feed plane along which the cut recording sheet 11 is transported. The toothed driven pulleys 21 are disposed under the first paper feed mechanism 9 so that the upper surfaces of the pin-traction belts 19 may extend along a paper feed plane along which the continuous recording paper 26 is transported in the region upstream of the transfer position. The toothed driving pulleys 20 are disposed at set positions near the fixing unit 8 on the same level as the toothed tension pulley 22. Thus, the belts 19 are directed by the pulleys 20, 21, and 22 along parallel paths in the region upstream of the transfer position and in the region between the transfer position and the position near the fixing unit 8, and the cut recording sheet 11 and the continuous recording paper 26 are transported along the same paper feed plane in the region between the transfer position and the position near the fixing unit 8, that is between the toothed driving pulleys 20 and the toothed driven pulleys 22. The fixing unit 8 is mounted on the frame. The fixing unit 8 comprises a casing 8*c*, and pair of fixing rollers 8a and 8b encased in the casing 8c and heated by heating means, not shown. A sheet detector 27, which is the same as the sheet detector 16, is provided to detect the leading edge of the continuous recording paper 26. A cutting unit 24 for cutting the continuous recording paper 26 along the width comprises a movable cutting blade 24a and a fixed cutting blade 24b. Normally, the movable cutting blade 24a is biased upward to an upper position by extension springs 24c. The movable cutting blade 24a is depressed by an actuator, not shown, so as to move downward along guide grooves, not shown, to cut the continuous recording paper 26. A delivery roller unit 25 comprises a pair of delivery rollers 25a and 25b pressed against each other and journaled on the frame for rotation. The fixing rollers 8a and 8b and the delivery rollers 25a and 25b can be driven through a transmission mechanism by the driving unit in either the normal direction or the reverse direction. The feed roller 12, the sheet separating unit 13, the register unit 14, the pin tractor mechanism 19, the fixing rollers 8a and 8b, and the delivery rollers 25a and 25b are driven synchronously at the same surface speed as that of the photoconductive drum 1.

Figure 5:
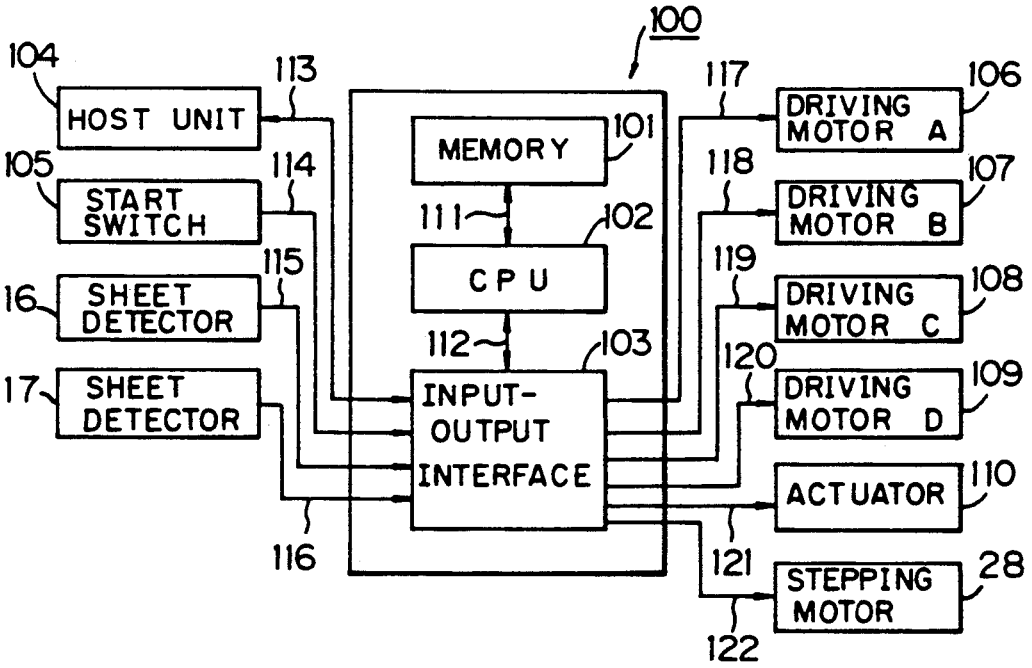
FIG. 5 is a block diagram of the electrical constitution of the electrophotographic recording apparatus of FIG. 1.

FIG. 5 shows the electrical constitution of the electrophotographic recording apparatus. In FIG. 5, only components relevant to the present invention, such as driving motors, the sheet detectors 16 and 17, a start switch, and a host unit, are shown and electrical components relating to an image forming process, which is of a known system, are omitted. Referring to FIG. 5, a microcomputer 100 comprises a memory 101 storing a control program, a central processing unit (hereinafter abbreviated to "CPU") 102, and an input-output interface 103. The memory 101 and the input-output interface 103 are connected to the CPU 102 by buses 111 and 112 respectively. A host unit 104, a start switch 105, the sheet detectors 16 and 27, a driving motor A 106, a driving motor B 107, a driving motor C 108, a driving motor D 109, an actuator 110 and the stepping motor 28 are connected to the input-output interface 103 respectively by lines 113 to 122. Recording data transferred from the host unit 104 to the microcomputer 100 is stored temporarily in the memory 101. The driving motor A 106 drives the photoconductive drum 1 (FIGS. 1 and 2) for rotation, the driving motor B 107 drives the feed roller 12 (FIGS. 1 and 2) for rotation through a transmission mechanism, not shown, such as a gear train. The driving motor C 108 drives the sheet separating unit 13 and the register unit 14 for rotation through a transmission mechanism, not shown, such as a gear train. The driving motor D 109 drives the fixing rollers 8a and 8b and the delivery rollers 25a and 25b for rotation through a transmission mechanism, not shown, such as a gear train. The stepping motor 28 drives the shaft 20a (FIG. 1) holding the toothed driving pulleys 20 of the pin tractor mechanism 18 for rotation. The actuator 110 actuates the movable cutting blade 24a of the cutting unit 24 (FIGS. 1 and 2).

Figure 6:
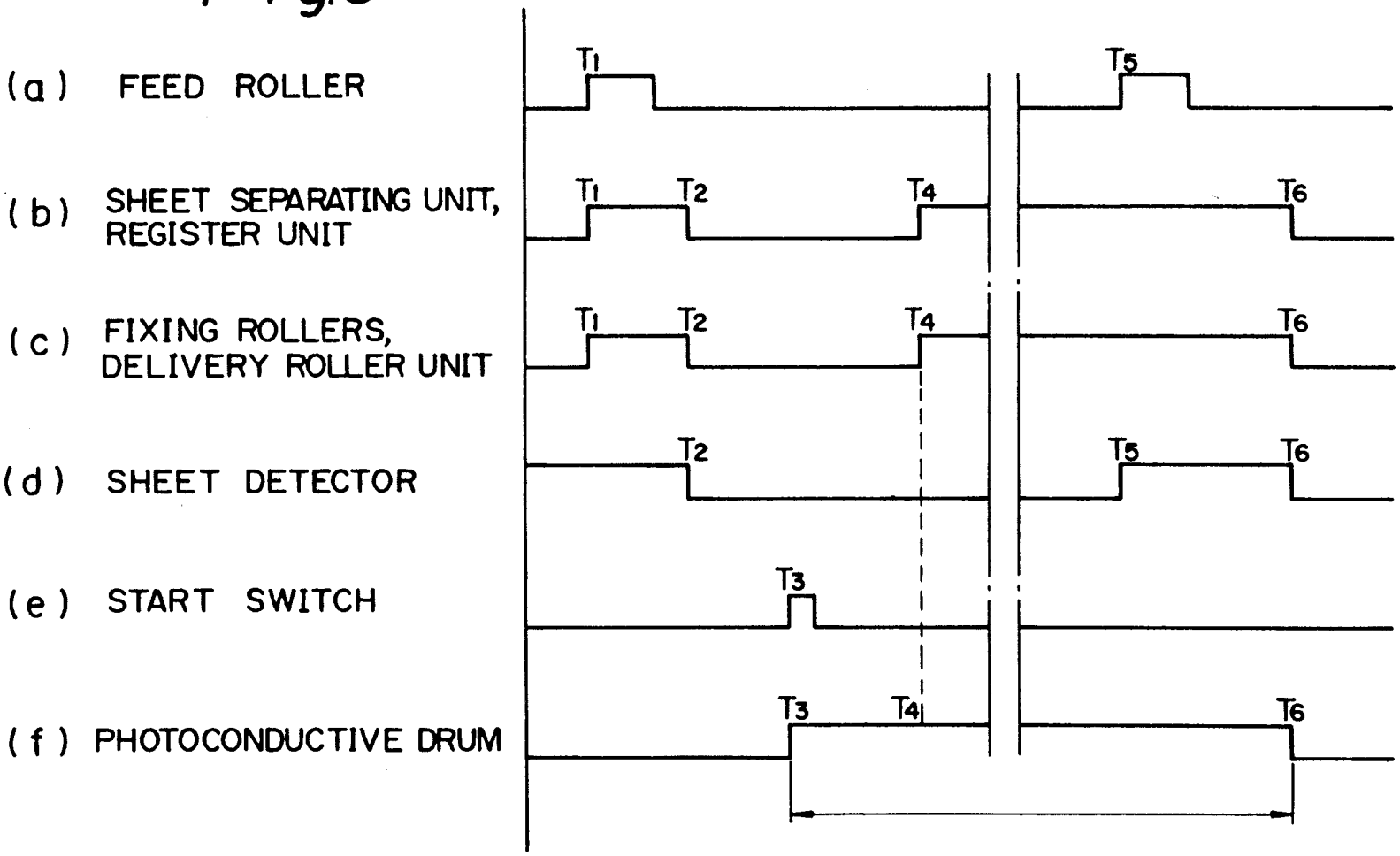
FIG. 6 is a sequence diagram of assistance in explaining the operation of the electrophotographic recording apparatus of FIG. 1 in a cut recording sheet feed mode.
Figure 7:
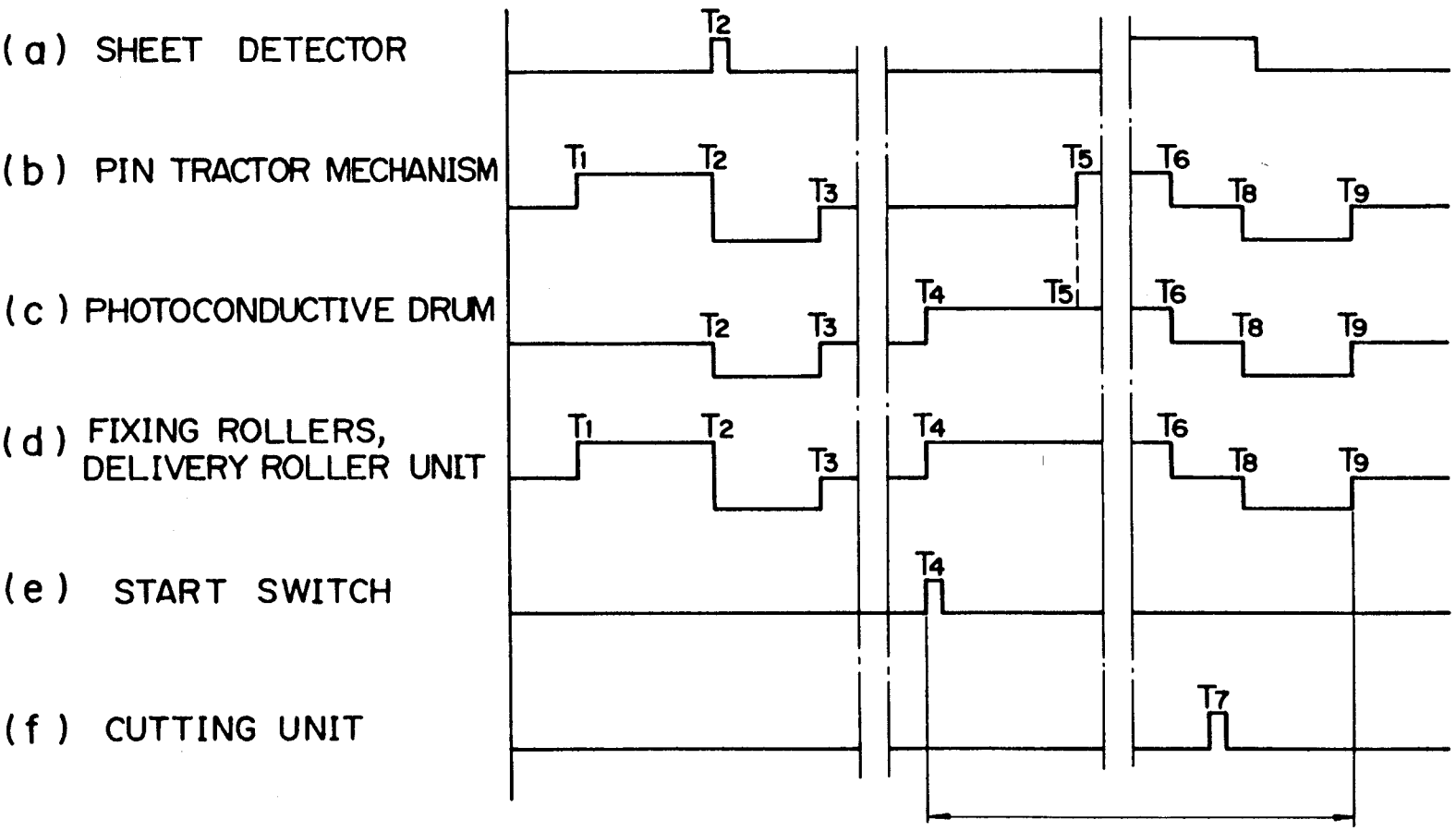
FIG. 7 is a sequence diagram of assistance in explaining the operation of the electrophotographic recording apparatus of FIG. 1 in a continuous recording paper feed mode.

The operation of the electrophotographic recording apparatus will be described hereinafter with reference to FIGS. 6 and 7.

First the operation in a cut recording sheet feed mode will be described with reference to FIG. 6. The cut recording sheets 11 are stacked in the cassette 10 (FIGS. 1 and 2). The main switch, not shown, of the electrophotographic recording apparatus is closed and the electrophotographic recording apparatus is ready to start. The mode selector switch of the control unit, not shown, is thrown to a position for the cut recording sheet feed mode at time $T_1$ to select the cut recording sheet feed mode. The microcomputer 100 carries out the following control operation according to the control program stored in the memory 101. The microcomputer 100 actuates the driving motors B 107, the driving motor C 108 and the driving motor D 109 to drive the feed roller 12, the sheet separating unit 13, the register unit 14, the fixing rollers 8a and 8b and the delivery roller unit 25 so that the cut recording sheet 11 is fed in the direction of an arrow B. Then, the uppermost cut recording sheet 11 is fed from the cassette 10 in the direction of the arrow B by the feed roller 12. Even if a plurality of superposed cut recording sheets 11 are sent out from the cassette 10, the sheet separating unit 13 separates the cut recording sheets 11 without fail. The driving motor B 107 stops after turning the feed roller 12 fully once. Upon the detection of the leading edge of the cut recording sheet 11, namely, upon the detection of arrival of the cut recording sheet 11 at the starting position, at time $T_2$, the output signal of the sheet detector 16 goes LOW as shown by a diagram (d) in FIG. 6. Upon the reception of the LOW output signal of the sheet detector 16, the microcomputer 100 stops the driving motor C 108 and the driving motor D 109 to stop the sheet separating unit 13, the register unit 14, the fixing rollers 8a and 8b and the delivery roller unit 25, and sends a signal indicating the placement of the cut recording sheet 11 at the starting position to the host unit 104. The operator closes the start switch 105 of the host unit 104 at time $T_3$ after visually confirming the placement of the cut recording sheet 11 at the starting position. Then, the host unit 104 transfers image data to the memory 101 of the microcomputer 100, and then the microcomputer 100 actuates the driving motor A 106 to rotate the photoconductive drum 1 in the direction of an arrow A. Then, the image data is read from the memory 101 and a toner image corresponding to the image data is formed on the circumference of the photoconductive drum 1 by the charging unit 4, the exposure unit 5 and the developing unit 6 (FIG. 2). Upon the arrival of the first line of the toner image at a position which will coincide with a set recording position on the cut recording sheet 11 at the transfer position at time $T_4$ as indicated by a diagram (f) in FIG. 6, the microcomputer 100 actuates the driving motor C 108 and the driving motor D 109 to drive the sheet separating unit 13, the register unit 14, the fixing rollers 8a and 8b and the delivery roller unit 25 for rotation. Then, the cut recording sheet 11 starts advancing in the direction of the arrow B, and the toner image formed on the circumference of the photoconductive drum 1 is transferred to the cut recording sheet 11 at a predetermined recording position. The toner image transferred to the cut recording sheet 11 is heat-fixed by the fixing rollers 8a and 8b of the fixing unit 8. Then, the cut recording sheet 11 carrying the fixed toner image is delivered by the delivery roller unit 25. On the other hand, upon the passage of the trailing edge of the cut recording sheet 11 past the sheet detector 16 at time $T_5$, the output signal of the sheet detector 16 goes HIGH. Then, the microcomputer 100 actuates the driving motor B 107 to feed the next uppermost cut recording sheet 11, namely, the second cut recording sheet 11, by the feed roller 12 to the sheet separating unit 13. The driving motor B 107 is stopped after the feed roller 12 has been turned fully once. Then, at time $T_6$, the sheet detector 16 detects the leading edge of the second cut recording sheet 11 and the output signal of the sheet detector 16 goes LOW again. Then, the microcomputer 100 stops the driving motor A 106, the driving motor C 108 and the driving motor D 109 to stop the photoconductive drum 1, the sheet separating unit 13, the register unit 14, the fixing rollers 8*a* and 8*b* and the delivery roller unit 25. Then, the electrophotographic recording apparatus remains standing by until the start switch 105 is closed. One recording cycle is completed in a period between the time $T_3$ and the time $T_6$.

The operation of the electrophotographic recording apparatus in the continuous recording paper feed mode, in which the mode selector switch is thrown to a position for the continuous recording paper feed mode, will be described hereinafter with reference to FIG. 7.

First, the free end of the continuous recording paper 26 corresponding to the first page is placed on the pin-traction belts 19 in the paper lead-in region G with the perforations 26*a* receiving the pins 19*a*. Then, the mode selector switch of the control unit is thrown to the position for the continuous recording paper feed mode at time $T_1$ indicated on diagram (b) and (d) in FIG. 7. The microcomputer 100 carries out an initializing operation according to the control program stored in the memory 101. The microcomputer actuates the driving motor D 109 and the stepping motor 28 to drive the fixing rollers 8*a* and 8*b* and the delivery rollers 25*a* and 25*b* of the delivery roller unit 25 for rotation and to drive the pin tractor mechanism 18. The stepping motor 28 rotates the toothed driving pulleys 20 in a counterclockwise direction to feed the continuous recording paper 26 in the direction of an arrow C (FIGS. 1 and 2). The driving motor D 109 rotates the fixing roller 8*a* and the delivery roller 25*a* in a clockwise direction and rotates the fixing roller 8*b* and the delivery roller 25*b* in a counterclockwise direction. Upon the detection of the leading edge of the continuous recording paper 26 by the sheet detector 27 at time $T_2$ as indicated on a diagram (a) in FIG. 7, the microcomputer 100 makes the driving motor A 106, the driving motor D 109 and the stepping motor 28 rotate in the reverse direction respectively by predetermined numbers of turns to reverse the photoconductive drum 1, the pin tractor mechanism 18, the fixing rollers 8*a* and 8*b* and the delivery roller unit 25 so that the continuous recording paper 26 is reversed. Consequently, the leading edge of the continuous recording paper 26 is moved to and stopped at a starting position located before the transfer unit 7 (FIGS. 1 and 2) at time $T_3$. The position of the leading edge of the continuous recording paper 26 at the time $T_3$ is the initial position of the continuous recording paper 26. Then, the microcomputer 100 gives a signal indicating the arrival of the leading edge of the continuous recording paper 26 at the starting position to the host unit 104. After visually confirming the coincidence of the leading edge of the continuous recording paper 26 with the starting position, the operator closes the start switch 105 of the host unit 104 at time $T_4$ as indicated on a diagram (e) in FIG. 7. Then, the host unit 104 transfers image data to be recorded to the memory 101 of the microcomputer 100, and the microcomputer 100 actuates the driving motor A 106 and the driving motor D 109 to rotate the photoconductive drum 1, the fixing rollers 8*a* and 8*b* and the delivery roller unit 25. As the photoconductive drum 1 rotates in the direction of an arrow A, a toner image is formed on the circumference of the photoconductive drum 1 by the charging unit 4, the exposure unit 5 and the developing unit 6. Upon the arrival of the first line of the toner image formed on the photoconductive drum 1 at a position which will coincide with a predetermined recording position on the continuous recording paper 26 at the transfer position at time $T_5$ indicated on diagrams (b) and (c) in FIG. 7, the microcomputer 100 actuates the stepping motor 28 to drive the pin tractor mechanism 18, and thereby the continuous recording paper 26 is advanced again in the direction of the arrow C. The toner image formed on the photoconductive drum 1 is transferred to the continuous recording paper 26 by the transfer unit 7 at the transfer position. The toner image transferred to the continuous recording paper 26 is heat-fixed by the fixing rollers 8*a* and 8*b* of the fixing unit 8, and the continuous recording paper 26 is advanced further by the delivery roller unit 25. A predetermined time after the reception of a signal indicating the end of transfer of the image data from the host unit 104, the microcomputer 100 stops the driving motor A 106, the driving motor D 109 and the stepping motor 28 at time $T_6$ indicated on the diagrams (b), (c) and (d) in FIG. 7 to stop the photoconductive drum 1, the fixing rollers 8*a* and 8*b*, the delivery roller unit 25 and the pin tractor mechanism 18. Then, at time $T_7$, the microcomputer 100 actuates the actuator to cut the continuous recording paper 26 by the cutting unit 24 (FIGS. 1 and 2). Then, at time $T_8$, the microcomputer 100 actuates the driving motor A 106, the driving motor D 109 and the stepping motor 28 for reverse rotation to reverse the continuous recording paper 26. At time $T_9$, the microcomputer 100 stops the driving motor A 106, the driving motor D 109 and the stepping motor 28 so that the continuous recording paper 26 is stopped at the starting position. Thereafter, the image recording cycle between the time $T_4$ and the time $T_9$ is repeated until a page end signal is provided.

Although the present invention has been described with reference to a specific embodiment thereof, the present invention is not limited in its practical application to the foregoing embodiment and many changes and variations are possible therein.

Figure 8:
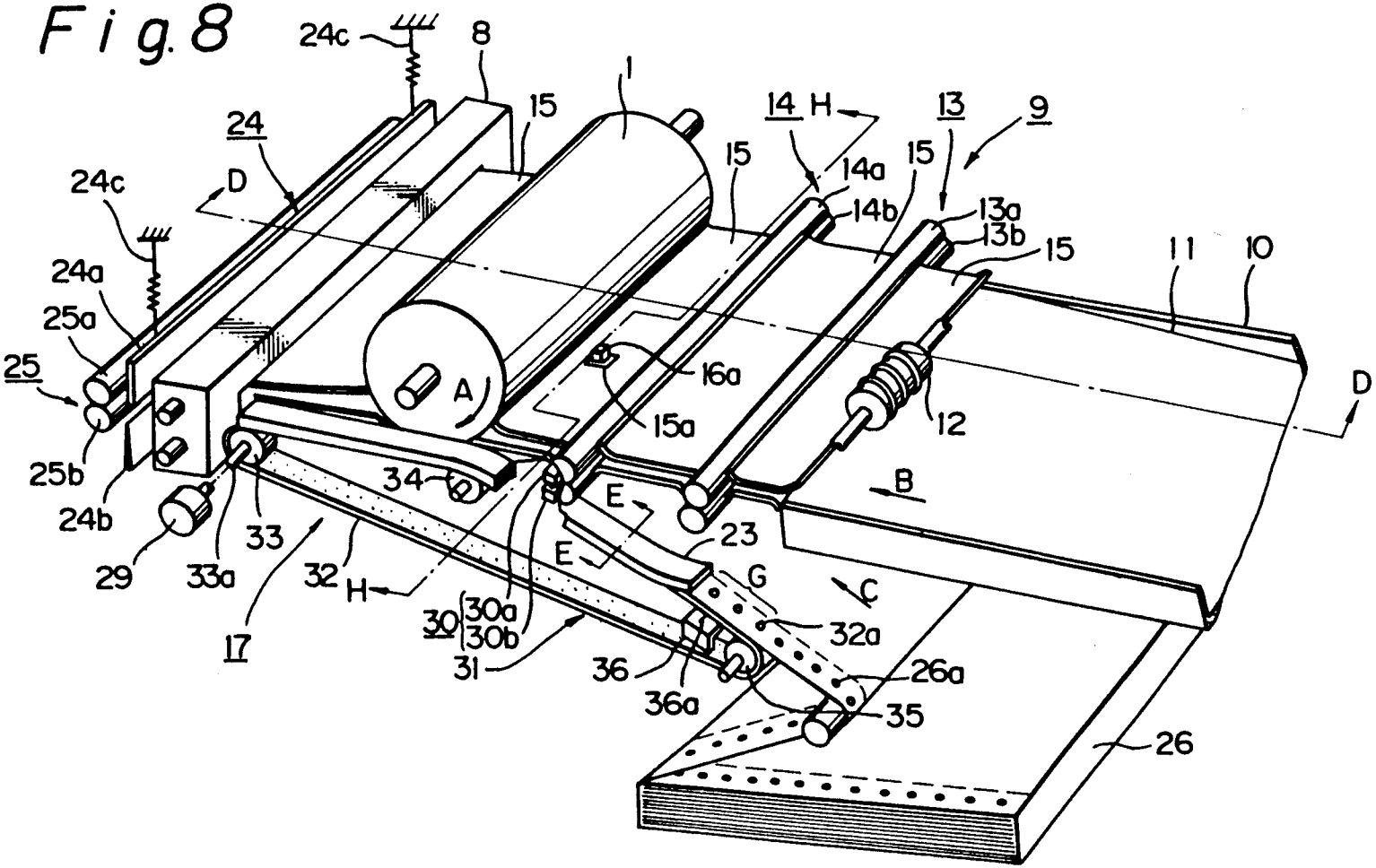
FIG. 8 is a schematic perspective view of an electrophotographic recording apparatus in a second embodiment according to the present invention.

For example, as shown in FIG. 8, the stepping motor 28 for driving the second paper feed mechanism 17 may be replaced with a DC motor 29, and the DC motor 29 may be controlled on the basis of the output signal of a detector 30 consisting of a luminous element 30*a* and a light receiving element 30*b* and disposed at a position corresponding to the starting position.

The combination of the pin tractor mechanism comprising the toothed pin-traction belts and the toothed pulleys, and the stepping motor for driving the pin tractor mechanism, employed in the foregoing embodiment may be replace with a combination of a pin tractor mechanism comprising flat pin-traction belts 32 and flatbelt pulleys 33, 34 and 35, and the DC motor 29 for driving the pin tractor mechanism. When the latter combination is employed, the detector 30 must be provided at the starting position to stop detect and stop the leading edge of the continuous recording paper correctly at the initial position regardless of slip between the flat pin-traction belts 32 and the flat-belt pulleys 33, 34 and 35.

In the foregoing embodiment, the continuous recording paper is advanced once until the leading edge thereof reaches near the cutting unit 24, and then the stepping motor 29 is reversed upon the detection of the leading edge of the continuous recording paper by the sheet detector 27 to locate the leading edge of the continuous recording paper at the starting position. However, it is also possible to locate the leading edge of the continuous recording paper 26 at the starting position by setting the continuous recording paper on the pin-traction belts 32 by visually confirming the coincidence of the leading edge of the continuous recording paper 26 with a positioning mark 36*a* provided on a positioning member 36 disposed near the pulley 35 as shown in FIG. 8, throwing the mode selector switch to the position for the continuous recording paper feed mode, driving the DC motor 29 to advance the continuous recording paper 26, and stopping the DC motor 29 upon the detection of the leading edge of the continuous recording paper 26 by the detector 30 disposed at a position corresponding to the starting position. Naturally, this continuous recording paper positioning procedure may be applied also to positioning the continuous recording paper 26 on the electrophotographic recording apparatus employing the stepping motor instead of the DC motor.

Although the invention has been described in its preferred form with a certain degree of particularity, it is to be understood that many variations and changes are possible in the invention without departing from the scope thereof.

What is claimed is:

1. In an electrophotographic recording apparatus having a first paper feed mechanism for feeding cut recording sheets, a second paper feed mechanism for feeding a continuous recording paper, and an electrophotographic recording system which includes a photosensitive member on which a toner image is formed, a transfer unit for transferring the toner image formed on the photosensitive member to the cut recording sheet or the continuous recording paper at a transfer position, and fixing unit for fixing the transferred toner image to the cut recording sheet or the continuous recording paper, the apparatus having a first region defined upstream of the transfer position and a second region defined between the transfer position and a position near the fixing unit, the first paper feed mechanism feeding the cut sheets through the first region in a first feed plane and feeding the cut sheets in the second region in a second feed plane, the improvement wherein the second paper feed mechanism feeds the continuous recording paper through the first and second regions, and wherein the second paper feed mechanism includes a tractor mechanism comprising a pair of longitudinally extending endless pin traction belts for carrying the continuous recording paper, each of said belts having pins projecting outwardly from upper surfaces of the belts and being longitudinally arranged along said upper surfaces at a pitch corresponding to that of perforations formed in the continuous recording paper, and means for directing the belts along parallel paths in said first and second regions, said paths passing respectively outside of opposite ends of the photosensitive member and passing through a continuous recording paper lead-in region, the transfer position and a position near the fixing unit, the belts carrying the continuous recording paper in a third paper feed plane, different from said first paper feed plane, in said first region and carrying the continuous recording paper in said second paper feed plane in said second region.

2. An electrophotographic recording apparatus as in claim 1, further comprising a cutting unit for cutting the continuous recording paper along a line perpendicular to a direction of feed of the continuous recording paper after the toner image has been transferred and fixed to the continuous recording paper.

3. An electrophotographic recording apparatus as in claim 2, further comprising:

means for selectively driving the tractor mechanism in a direction of feed and in a reverse direction opposite to the direction of feed, and means for controlling said driving means to drive said traction mechanism in the reverse direction so as to retract a leading edge of the continuous recording paper from the cutting unit to a starting position in the first paper feed plane.

4. An electrophotographic recording apparatus according to claim 3, wherein said driving means is a stepping motor.

5. An electrophotographic recording apparatus according to claim 3, wherein said driving means is a DC motor, and said means for controlling said driving means comprises a detector, disposed at a position corresponding to the starting position, for detecting the leading edge of the continuous recording paper.

6. An electrophotographic recording apparatus according to claim 3, wherein said driving means is a stepping motor having an output shaft, and said means for directing the pin-traction belts comprises a pair of toothed driving pulleys fixedly mounted on a shaft connected to the output shaft, and at least two pairs of toothed driven pulleys, the pair of pin-traction belts having on bottom surfaces thereof teeth which mesh with the teeth of the toothed driving pulleys and the toothed driven pulleys.

7. An electrophotographic recording apparatus according to claim 3, wherein said driving means is a DC motor having an output shaft, said means for controlling said driving means comprising a detector, disposed at a position corresponding to the starting position, for detecting the leading edge of the continuous recording paper, said means for directing the belts comprising a pair of driving pulleys fixedly mounted on a shaft connected to the output shaft and at least two pairs of driven pulleys, the pairs of driving and driven pulleys operatively engaging said belts.

* * * * *